US006266015B1

(12) United States Patent
Heckaman et al.

(10) Patent No.: US 6,266,015 B1
(45) Date of Patent: Jul. 24, 2001

(54) PHASED ARRAY ANTENNA HAVING STACKED PATCH ANTENNA ELEMENT WITH SINGLE MILLIMETER WAVELENGTH FEED AND MICROSTRIP QUADRATURE-TO-CIRCULAR POLARIZATION CIRCUIT

(75) Inventors: Douglas E. Heckaman, Indialantic; Walter M. Whybrew; Brett A. Pigon, both of Palm Bay; Gregory M. Jandzio; Gary A. Rief, both of Melbourne; James B. Nichols, Indialantic; Randy E. Boozer, Melbourne; Edward J. Bajgrowicz, Palm Bay, all of FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/619,234

(22) Filed: Jul. 19, 2000

(51) Int. Cl.[7] ..... H01Q 1/38; H01Q 21/00
(52) U.S. Cl. ..... 343/700 MS; 343/853
(58) Field of Search ..... 343/700 MS, 815, 343/816, 817, 818, 853; 342/368, 372, 375

(56) References Cited

U.S. PATENT DOCUMENTS

| | | | |
|---|---|---|---|
| 5,019,829 | 5/1991 | Heckman et al. | 343/700 |
| 5,023,624 | 6/1991 | Heckaman et al. | 343/860 |
| 5,065,123 | 11/1991 | Heckaman et al. | 333/246 |
| 5,165,109 | 11/1992 | Han et al. | 343/700 |
| 5,212,494 | 5/1993 | Hofer et al. | 343/859 |
| 5,218,373 | 6/1993 | Heckaman et al. | 343/786 |
| 5,227,808 | 7/1993 | Davis | 343/915 |
| 5,313,221 | 5/1994 | Denton, Jr. | 343/846 |
| 5,325,103 | 6/1994 | Schuss | 343/700 |
| 5,444,453 | 8/1995 | Lalezari | 343/700 |
| 5,453,752 | 9/1995 | Wang et al. | 343/700 |
| 5,471,223 | 11/1995 | McCorkle | 343/786 |
| 5,615,031 | 3/1997 | Saiuchi et al. | 349/149 |
| 5,672,221 | 9/1997 | Takagi | 156/109 |
| 5,694,134 | 12/1997 | Barnes | 343/700 |
| 5,726,666 | 3/1998 | Hoover et al. | 343/770 |
| 5,767,808 | 6/1998 | Robbins et al. | 349/700 |
| 5,831,578 | 11/1998 | Lefevre | 343/700 |
| 5,870,057 | 2/1999 | Evans et al. | 343/700 |
| 5,870,060 | 2/1999 | Chen et al. | 343/761 |
| 5,892,487 | 4/1999 | Fujimoto et al. | 343/840 |
| 5,904,801 | 5/1999 | Furukawa et al. | 156/382 |
| 5,906,337 | 5/1999 | Williams et al. | 244/158 |
| 5,995,049 * | 11/1999 | Komatsu et al. | 343/700 MS |
| 6,002,370 * | 12/1999 | McKinnon et al. | 343/700 MS |
| 6,020,853 | 2/2000 | Richards et al. | 343/700 |
| 6,195,047 * | 2/2001 | Richards | 343/700 MS |

* cited by examiner

*Primary Examiner*—Tan Ho
(74) *Attorney, Agent, or Firm*—Allen, Dyer, Doppelt, Milbrath & Gilchrist, P.A.

(57) ABSTRACT

A phased array antenna includes an antenna housing having a subarray assembly that supports beam forming network modules and an array face defining a ground plane substantially orthogonal to the subarray assembly. A plurality of millimeter wavelength patch antenna elements are positioned on the array face and each positioned adjacent a respective subarray assembly. The millimeter wavelength patch antenna elements each include a driven antenna element having a front and rear side and a parasitic antenna element positioned forward of the front side of the driven antenna element. A microstrip quadrature-to-circular polarization circuit is positioned rearward of the rear side of the driven antenna element and operatively connected to the driven antenna element. A single millimeter wavelength feed operatively connects the microstrip quadrature-to-circular polarization circuit with a respective adjacent beam forming network module supported on the orthogonal positioned subarray assembly.

32 Claims, 10 Drawing Sheets

PHASED ARRAY ANTENNA HAVING STACKED PATCH ANTENNA ELEMENT WITH SINGLE MILLIMETER WAVELENGTH FEED AND MICROSTRIP QUADRATURE-TO-CIRCULAR POLARIZATION CIRCUIT

FIELD OF THE INVENTION

This invention relates to phased array antennas, and more particularly, this invention relates to phased array antennas used at millimeter wavelengths.

BACKGROUND OF THE INVENTION

Microstrip antennas and other phased array antennas used at millimeter wavelengths are designed for use with an antenna housing and a MMIC (millimeter microwave integrated circuit) subsystem assembly used as a beam forming network. The housing can be formed as a waffle-wall array or other module support to support a beam forming network module, which is typically designed orthogonal to any array of antenna elements. Various types of phased array antenna assemblies that could be used for millimeter wavelength monolithic subsystem assemblies are disclosed in U.S. Pat. No. 5,065,123 to Heckaman, the disclosure which is hereby incorporated by reference in its entirety, which teaches a waveguide mode filter and antenna housing. Other microwave chip carrier packages having cover-mounted antenna elements and hermetically sealed waffle-wall or other configured assemblies are disclosed in U.S. Pat. No. 5,023,624 to Heckaman and U.S. Pat. No. 5,218,373 to Heckaman, the disclosures which are hereby incorporated by reference in their entirety. In the '624 patent, residual inductance of short wire/ribbon bonds to orthogonal beam forming network modules is controlled.

There are certain drawbacks associated with these and other prior art approaches. Above 20 and 30 GHZ, commercially available soft substrate printed wiring board technology does not have the accuracy required for multilayer circular polarized radiation elements, such as quadrature elements. A single feed circular polarized patch antenna element with an integral hidden circular polarized circuitry is desired for current wide scanning millimeter microwave (MMW) phased array applications. Various commercially available soft substrate layers have copper film layers that are thicker than desired for precision millimeter microwave circuit fabrication. Several bondable commercially available soft dielectric substrates have high loss at microwave millimeter wavelengths and the necessary rough dielectric-to-metal interface causes additional attenuation. Many commercially available dielectric substrates are not available in optimum thicknesses. Various dual feed microstrip elements with surface circuit polarized networks have been provided and some with polarizing film covers, but these have not been proven adequate. It would be desirable to minimize the different layers and use microwave integrated circuit materials and fabrication technologies for a phased array antenna with orthogonally positioned beam forming network modules at millimeter microwave wavelengths.

Additionally, the recent trend has been towards higher frequency phased arrays. In Ka-band phased array antenna applications, the interconnect from the element to the beam forming network modules is very difficult to form because the array face is typically orthogonal to the beam forming network modules and any antenna housing support structure.

Fully periodic wide scan phased array antennas require a dense array of antenna elements, such as having a spacing around 0.23 inches, for example, and having many connections and very small geometries. For circular polarized microstrip antennas, there are normally two quadrature feeds required, making the connections even more difficult at these limited dimensions. Some planar interconnects with linear polarization have been suggested, together with a pin feed through a floor if the area allows. Also, any manufacturable, reworkable interconnect that meets high performance requirements for three-dimensional applications with millimeter microwave integrated circuit technology is not available where planar elements must be electrically connected to circuitry positioned orthogonal to elements and meet the microwave frequency performance requirements. Performance must be consistent for each interconnection and the technology must be easily producible and easily assembled where the interconnection must be repairable at high levels of assembly. The technology must also support multiple interconnects over a small area.

SUMMARY OF THE INVENTION

The present invention is advantageous and provides a phased array antenna that uses a stacked patch antenna element and a single millimeter wavelength feed from a microstrip quadrature-to-circular polarization circuit. This allows the microstrip quadrature-to-circular polarization circuit to be operatively connected with a respective adjacent beam forming network module supported on the orthogonally positioned subarray assembly.

The phased array antenna includes an antenna housing having a subarray assembly that supports a plurality of beam forming network modules. An antenna array face defines a ground plane substantially orthogonal to the subarray assembly. A plurality of millimeter wavelength patch antenna elements are positioned on the array face adjacent a respective beam forming network module. The millimeter wavelength patch antenna elements each comprise a driven antenna element having front and rear sides and a parasitic antenna element positioned forward of the front side of the driven antenna element. A microstrip quadrature-to-circular polarization circuit is positioned rearward of the rear side of the driven antenna element and operatively connected to the driven antenna element. A single millimeter wavelength feed is operatively connected to the microstrip quadrature-to-circular polarization circuit and to a respective adjacent beam forming network module supported on the orthogonally positioned subarray assembly.

In one aspect of the present invention, the phased array antenna includes a ground plane layer and a dielectric layer formed between the parasitic antenna element and the microstrip quadrature-to-circular polarization circuit. The single millimeter wavelength feed further includes a conductive pin having a ball bond that interconnects the microstrip quadrature-to-circular polarization circuit. A wedge bond and ceramic microstrip substrate interconnects the conductive pin to the beam forming network module. A single millimeter wavelength feed includes a wire bond that interconnects the ceramic microstrip substrate to the beam forming network module.

A ribbon bond interconnects the single millimeter wavelength feed to the ceramic or other components. A plurality of millimeter wavelength patch antenna elements are conductively bonded to the array face of the antenna housing. The beam forming network includes an amplifier and a monolithic microwave integrated circuit (MMIC) and a connecting ceramic microstrip substrate. The antenna housing includes a housing core defining the subarray assembly, module support, a cover and waveguide mode filter post extending from the cover to the housing core.

In still another aspect of the present invention, the antenna housing includes a plurality of module supports that each support a beam forming network module and an array face substantially orthogonal to the module supports. The array face includes a plurality of waveguide below cut-off cavities formed within the array face and each positioned adjacent a respective module support.

A millimeter wavelength patch antenna element is positioned over each waveguide below cut-off cavity and includes a driven antenna element having a front and rear side and a parasitic antenna element positioned forward of the front side of the driven antenna element. A quadrature microstrip circular polarized circuit is positioned rearward of the rear side of the driven antenna element, at least partially received within the waveguide below cut-off cavity and operatively connected to the driven antenna element. A single millimeter wavelength feed connects the microstrip quadrature-to-circular polarization circuit and a respective adjacent beam forming network module supported on the orthogonally positioned subarray assembly.

In yet another aspect of the present invention, the phased array antenna can include an antenna housing comprising a subarray assembly that supports a plurality of beam forming network modules and an array face substantially orthogonal to the subarray assembly and a plurality of waveguide below cut-off cavities formed within the array face.

A millimeter wavelength patch antenna element is positioned over each conductive waveguide cavity and includes a primary substrate having front and rear sides. A driven antenna element is positioned on the front side of the primary substrate. A secondary substrate is spaced forward from the driven antenna element, and in one embodiment, has a parasitic antenna element formed thereon. The parasitic antenna element is not required, however. A ground plane layer is formed on the rear side of the primary substrate. A dielectric layer is positioned on the ground plane layer. A microstrip quadrature-to-circular polarization circuit is positioned on the dielectric layer and at least partially received within the waveguide below cut-off cavity. Conductive signal vias extend from the microstrip quadrature-to-circular polarization circuit to the ground plane layer and the driven antenna element. A single millimeter wavelength feed connects the microstrip quadrature-to-circular polarization circuit with a respective adjacent positioned beam forming module supported on the orthogonal positioned subarray assembly.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

Figure 1:
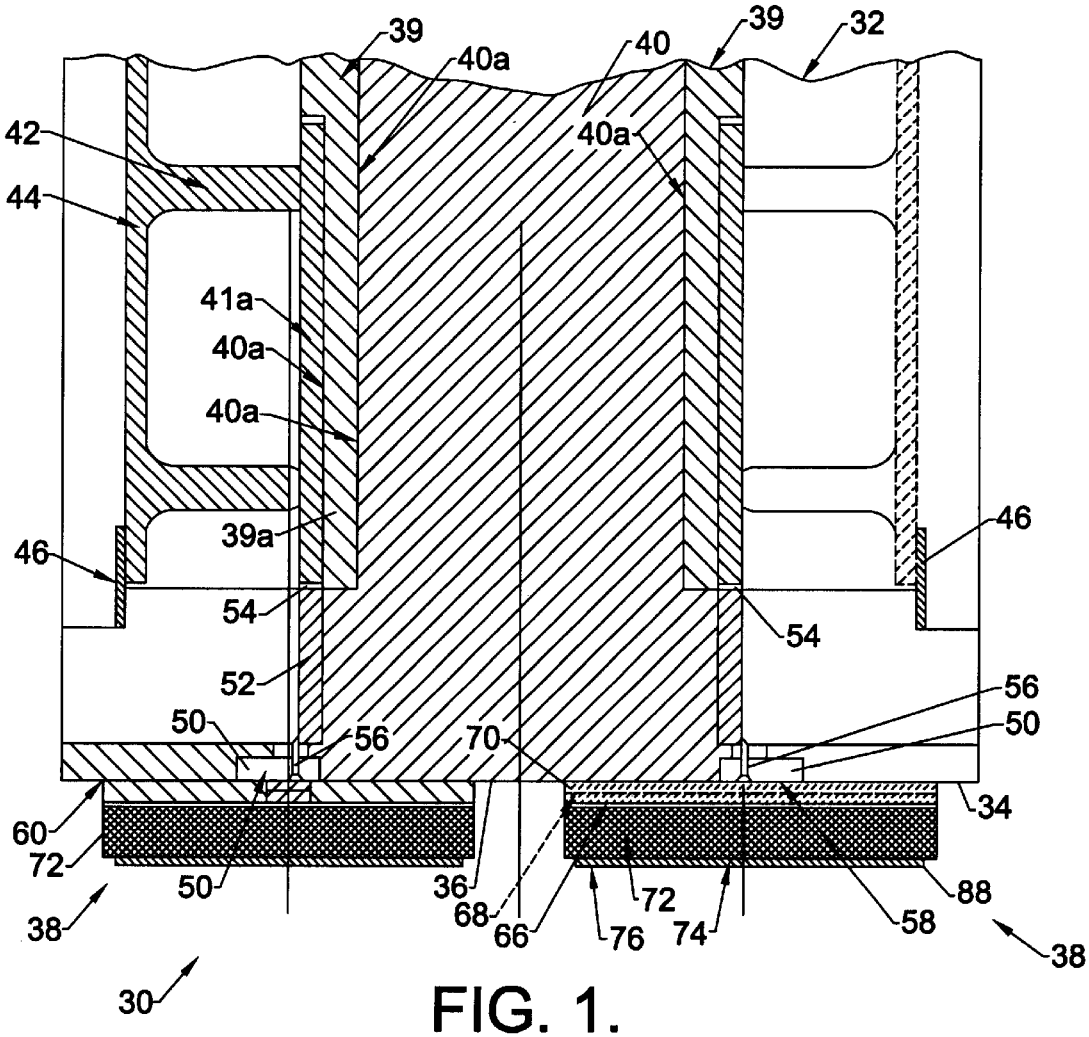
FIG. 1 is a sectional view of an antenna housing having a plurality of millimeter wavelength patch antenna elements positioned on an array face in accordance with one embodiment of the present invention.
Figure 2:
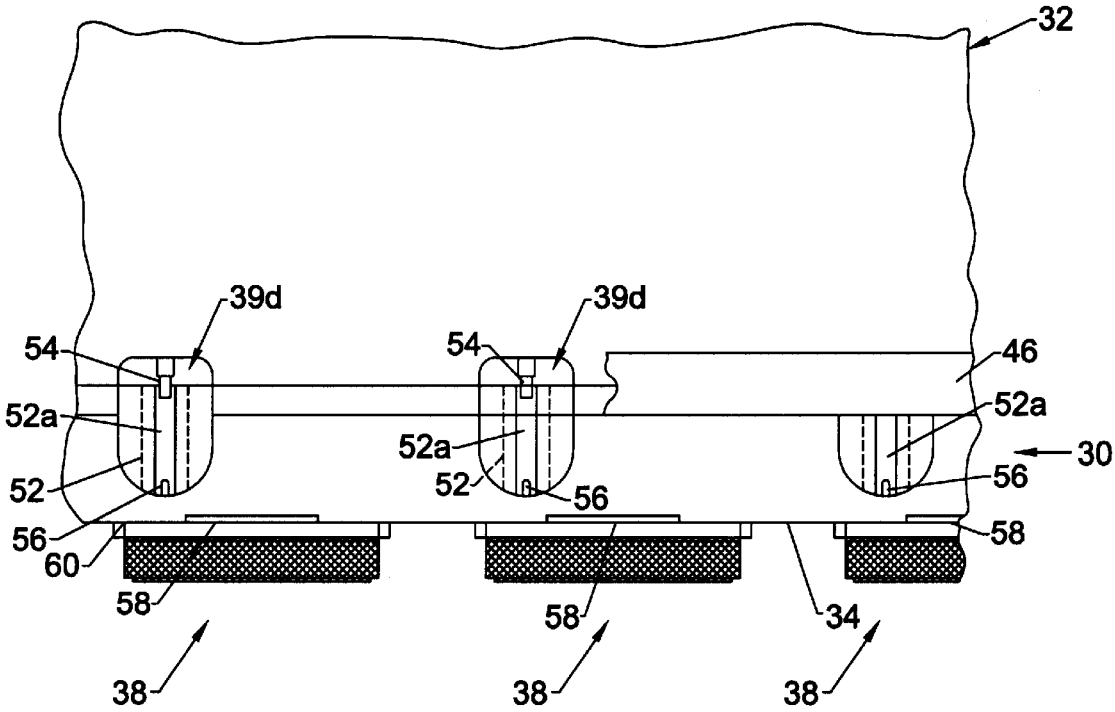
FIG. 2 is a top plan view of the antenna housing shown in FIG. 1.
Figure 3:
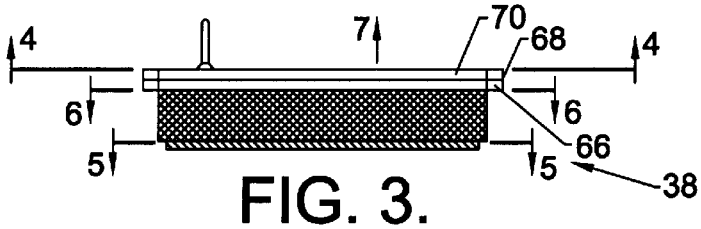
FIG. 3 is an elevation view of one embodiment of a patch antenna element of the present invention using a conductive pin for a single millimeter wave feed.

Referring now to FIGS. 1 and 2, there are illustrated the sectional and top views of one embodiment of the phased array antenna 30 of the present invention. The antenna housing 32 has an array face 34 that defines a ground plane layer 36, such as formed from grounding layer metallization or other techniques known to those skilled in the art. A plurality of millimeter wavelength patch antenna elements 38 are positioned on the array face as shown by the patch antenna element of FIG. 3. As shown in FIGS. 1 and 2, the antenna housing 32 includes a subarray assembly formed in the illustrated embodiment as a tray core 40 having a module support 40*a*. The tray core 40 could be formed from a metallized ceramic material or other material known to those skilled in the art. In one aspect of the present invention, the tray core is formed of a metal alloy that has a thermal coefficient of expansion that is compatible with what type of beam forming network module is to be used. A side cut-out, or cavity, is formed at the side surface of the tray core and allows a beam forming network module 39 to be secured therein. The beam forming network module 39 is conductively bonded to the tray core in the module support. A conductive bonding film is used. The beam forming network module includes a KaECA carrier, as known to those skilled in the art, which is conductively bonded to the tray core. A monolithic millimeter wave integrated circuit 39*a* and a filter substrate 41*a* are part of the beam forming network module. These parts include an amplifier component. These parts are attached to the carrier, i.e., module 39, by using a conductive bonding film. The module includes a waveguide mode filter post 42 and cover 44 and include a grounding tape 46 along the surface of the cover. The filter substrate 41*a* and other components of the beam forming network module are illustrated as positioned orthogonal to the array face 34. In FIG. 2, cut-outs 39*d* are illustrated and formed in the cover where a wire bonding machine head can enter to accomplish the necessary bonding. The large surface of the tape is actually the outer surface of the module cover.

Where each patch antenna element is located, a waveguide below cut-off cavity 50 is formed at the array face and associated with a respective beam forming network module 39. This shallow cavity eliminates a dielectric and metal layer and acts as part of the ground plane. It could be formed from metallized green tape layers having internal circuitry or other structures known to those skilled in the art.

A ceramic microstrip substrate 52 having at least one microstrip feed line 52*a* extends from adjacent the waveguide below cut-off cavity 50 to the beam forming network module 39. The ceramic microstrip substrate 52 can include a gold ribbon bond 54 interconnecting the feed line 52*a* and module. The lower part of the feed line 52*a* on the ceramic microstrip substrate is connected by an antenna element output wire bond formed as a pin 56 to a microstrip quadrature-to-circular polarization circuit 58 formed as part of the patch antenna element 38. The shallow waveguide below cut-off cavity provides the top ground plane and shield/housing for the backside microstrip circuit 58. The pin 56, and in some cases ribbon connection, and the substrate 52, minimize the effective inductance of the wire length. The cavity depth might be 3–5 times the thickness of a dielectric layer formed on the backside of a primary substrate of the patch antenna element as explained below. This inductance could be "tuned out" by capacitive oversize bonding pads as explained in the incorporated by reference '924 patent.

Figure 4:
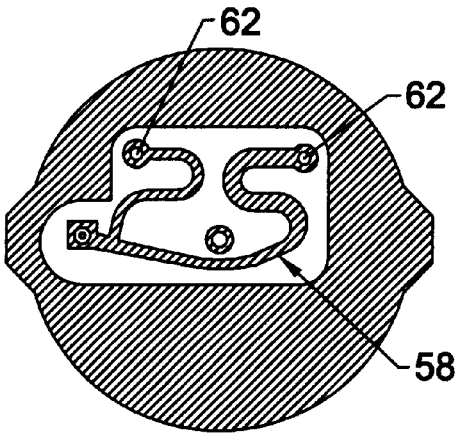
FIGS. 4–6 are various cut away views of the patch antenna element of FIG. 3 taken along lines 4—4, 5—5 and 6—6 of FIG. 3.
Figure 5:
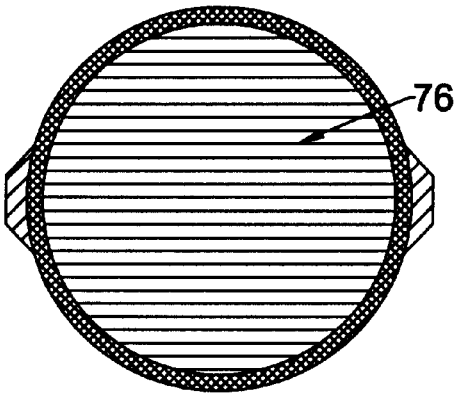
Figure 6:
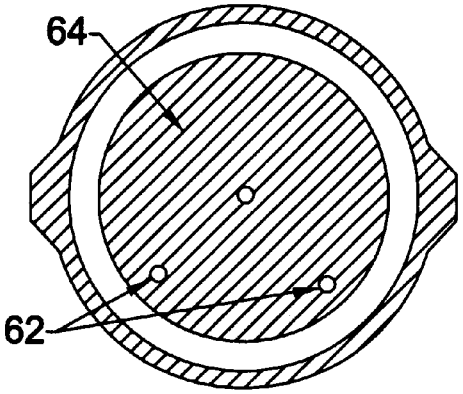
Figure 7:
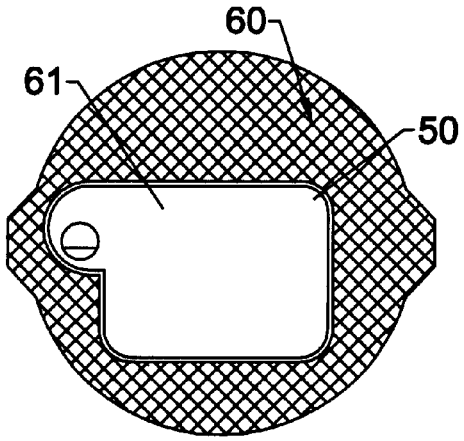
FIG. 7 is a plan view of the microstrip cover pocket and conductive bonding film.

FIGS. 3–7 show basic details of a patch antenna element 38 in one aspect of the present invention. In this one particular embodiment, the patch antenna element 38 is attached by a conductive bonding film 60 onto the array face, as shown in FIG. 7, where a microstrip cover cavity 61 in the array face to accommodate circuits. The antenna element includes the backside quadrature microstrip circular polarized circuit 58, as shown in FIG. 4, having the attached signal feed via the signal pin 56 connection and signal vias 62 connected to a driven antenna element 64. A primary substrate 66 has front and rear sides and the driven antenna element 64 is formed on the front side of the primary substrate. A ground plane layer 68 is formed on the rear side of the primary substrate, and a dielectric layer 70 is formed on the ground plane layer 68. The microstrip quadrature-to-circular polarization circuit is formed over that dielectric layer and could include other polyamide layers (not shown in detail). The primary substrate could be a spun-on layer that is lapped to a desired thickness and could be $SiO_2$. The quadrature-to-circular polarization circuit could be a reactive power divider and 90° delay line or a Lange coupler with crossovers.

A foam spacer 72 (FIG. 1) separates a secondary substrate 74 having a parasitic antenna element 76 that is spaced forward from the driven antenna element 62. The foam spacer 72 forms at least one spacer between the parasitic antenna element layer and the primary substrate. This foam spacer 72 is dimensioned for enhanced parasitic antenna element performance at millimeter wavelength radio frequency signals. When the patch antenna elements are formed together, it is evident that they can be placed onto an antenna housing by pick and place apparatus where the pin 56 extends to the microstrip feed line 52*a* on the substrate.

Figure 17:
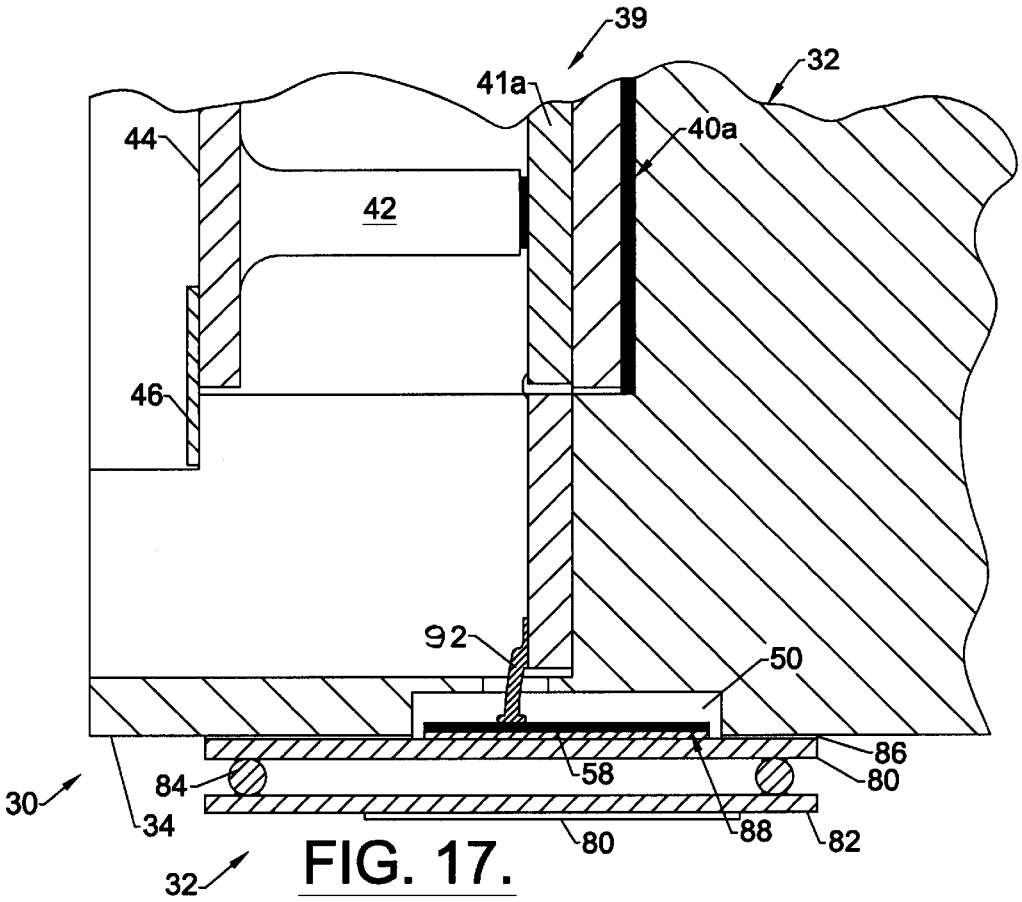
FIG. 17 is a sectional view of another embodiment showing the antenna housing with the waveguide below cut off cavity in detail.
Figure 18:
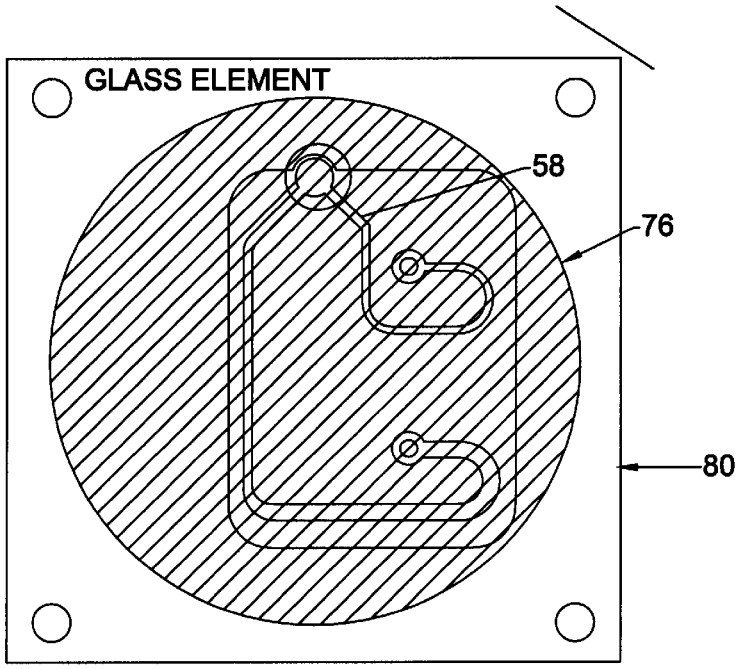
FIG. 18 is an x-ray view looking from the front side, showing the parasitic patch metal layer, spacer balls, formed dielectric layer on the backside of the primary substrate and the microstrip quadrature-to-circular polarization circuit.

Referring now to FIG. 17, there is illustrated another embodiment of a phased array antenna element where the spacer is formed as a dielectric and between a secondary antenna element layer 82 having a parasitic element and the primary substrate 80. The spacer is formed as precision diameter spaced balls 84, thus, allowing a predetermined spacing between the primary and secondary substrates. A conductive adhesive bond (or gold/tin solder attachment) 86 secures the primary substrate (or gold/tin attachment). The backside dielectric layer and ground plane 88 include the microstrip quadrature-to-circular polarization circuit 58 as described before, and positioned within the cavity. FIG. 18 is an x-ray view of the radiation element (antenna element). Looking from the front side, the first item is the secondary substrate 78, with the circular parasitic antenna element 76 metal film on the backside. Under this, the supporting precision diameter spacer balls 84 can be seen. The rectangular shape is the dielectric layer formed on the backside of the primary substrate 80. Below is the etched circuit microstrip quadrature-to-circular polarization circuit 58 metal layer. Several layers are not shown. In the different embodiments, the primary substrate could be formed from glass, including fused quarts, ceramics, such as alumina and beryllia, semiconductor materials, such as GaAs, or other materials known to those skilled in the art. The pin 92 in this embodiment is formed flexible and could be an illustrated ribbon bond, still providing a single millimeter wavelength feed.

Figure 11:
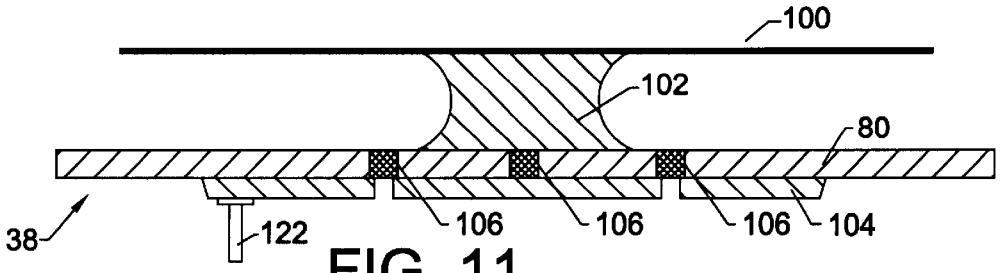
FIGS. 11–16 show different embodiments of millimeter wavelength patch antenna elements with spacing between the primary substrate and secondary substrate, which include the driven and parasitic elements.

FIG. 11 shows a different embodiment of an antenna element spacer used for spacing the driven antenna element and parasitic antenna element. FIG. 11 shows a parasitic element layer 100 without a thick substrate. The primary substrate 80 with a formed (or deposited) low temperature dielectric glass or polyamide center pedestal 102 forms the separation bond. On the back of the primary substrate could be a glass or polyamide layer 104 that would allow the photofabrication of the microstrip quadrature-to-circular polarization circuit. This circuit has signal and ground vias 106 that extend through to the driven antenna element positioned on the front side of the primary substrate. The connecting wire bond is shown extending from the backside metallization on 104.

Figure 12:
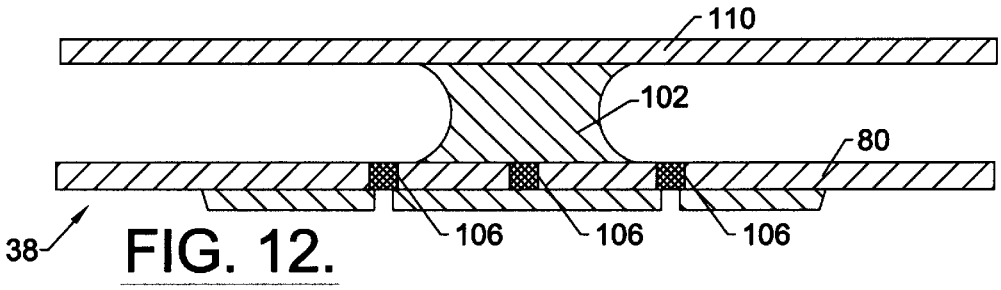
Figure 13:
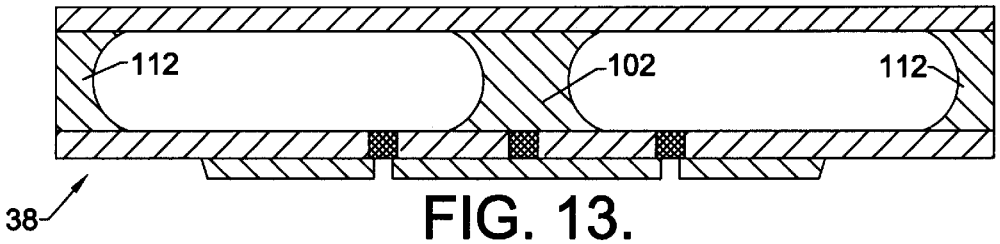
Figure 14:
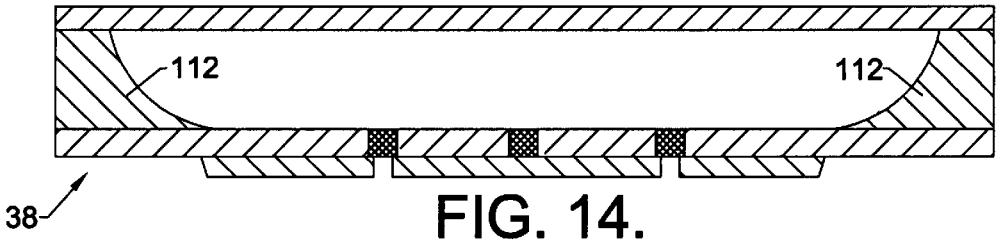
Figure 15:
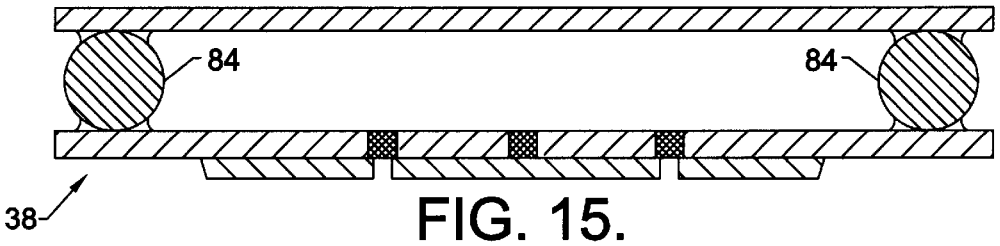
Figure 16:
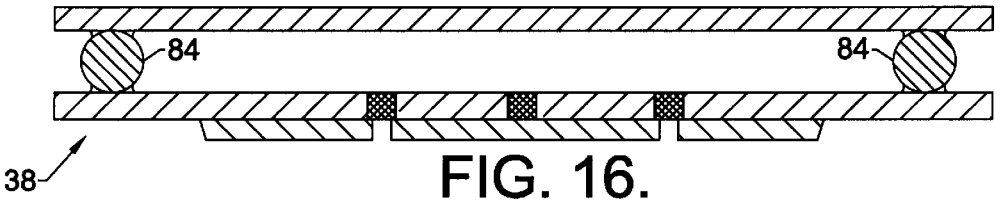

FIGS. 12–16 show other embodiments. FIG. 12 has a secondary substrate 110 and the glass or polyamide center pedestal 102. FIG. 13 has end supports 112 forming a peripheral frame structure and the glass or polyamide center pedestal 102. FIG. 14 does not have a center pedestal, but includes the end supports 112. FIGS. 15 and 16 show spacing with spherical balls, where a larger diameter ball for a different spacing waveguide performance is shown in FIG. 15. These balls are formed as precision diameter glass or polyamide balls. The peripheral frame structures 112 could be etched in a dielectric, such as bonded glass or polyamide, as shown in FIGS. 13 and 14, as well as the center pedestal shown in FIGS. 11, 12 and 13. The spacing is set for millimeter microwave dimensions and enhances performance of the antenna elements.

The diameter of the ball spacer or the formed dielectric layer spacer can be held to a tighter tolerance than what can be done with less accurate printed wire board technology. The formed dielectric layers, front and back, can be ground or lapped to a tight thickness tolerance. The primary glass, ceramic or crystal substrate can be ground and polished to a tight thickness tolerance before the backside ground plane and front side primary radiation element are formed.

At this point, the metal parasitic element layer can be just a metal film or a metal film on a suspended dielectric substrate (FIGS. 15 and 16). In the case where ball spacers are used, there is no formed dielectric layer on the front side of the primary substrate. A window is etched into the formed dielectric layer on the front face of the primary substrate. This window etch may be so deep that it exposes the driven element formed on the front side of the primary substrate. The formed dielectric layer might be lapped to a tight thickness tolerance before window formation. After etching the window opening over the primary element, the parasitic element formed on a second glass substrate is bonded to the top surface of the formed dielectric layer (FIG. 14).

For best antenna element performance, it is important to minimize the use of dielectric material in the cylinder volume between the parasitic and driven radiation element metal layers. It is possible, and advantageous in some circumstances, to have no dielectric material in this volume. In the lower frequency PWB versions, a low dielectric constant foam is used to fill up this volume.

In each of these, the primary and secondary substrates could be formed from a dielectric material, such as from glass, fused quartz, ceramics such as alumina or beryllia, or a semiconductor substrate such as GaAs.

Figure 18A:
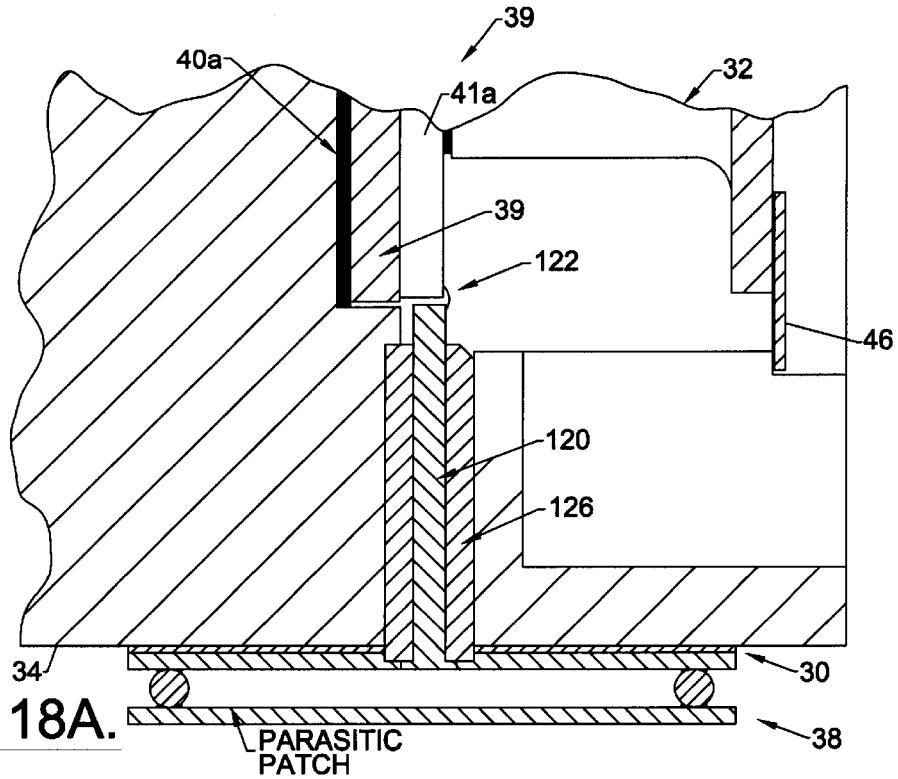
FIG. 18A is a sectional view of another embodiment using a square pin coaxial lead with Teflon.
Figure 18B:
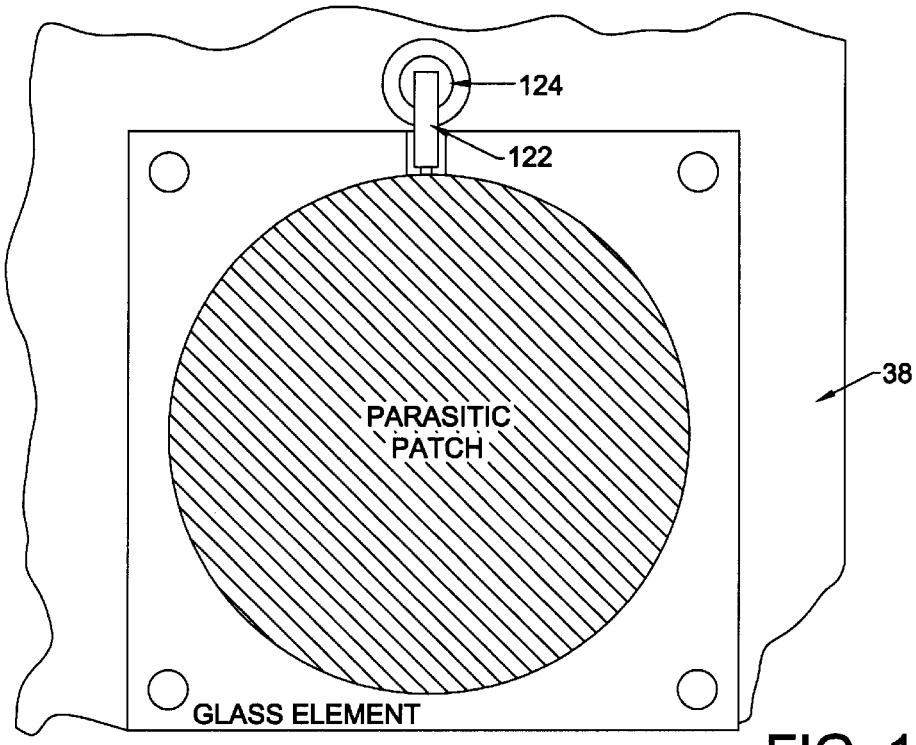
FIG. 18B is a plan view of the antenna element shown in FIG. 18A.

FIGS. 18A and 18B illustrate another embodiment having no waveguide below cut-off cavity as before, but the embodiment still retains a patch antenna element with a single 50 ohm square pin coaxial line 120 connected via a wire bond 122 connected to the module 39. It includes a coaxial line pin head 124 and dielectric encirclement 126, such as formed from a dielectric sold under the trade designation Teflon.

The backside microstrip quadrature-to-circular polarization circuit in the waveguide below cut-off cavity 50 can still be used in this approach. The difference is that the signal does not travel through a signal pin 92 or wire that exists through a hole in the cavity "floor" as shown in FIG. 17. The signal travels from the backside circuit, through vias, up to the front surface of the primary substrate and from there to the edge of the substrate through a formed microstrip transmission line. A gold interconnection ribbon is bonded to the microstrip transmission line at one end and at the other end is bonded to the pin head 124 of the square pin coaxial line 20 located near a side of the patch radiation element 38. The wire in FIG. 18A is not the same location as the wire connecting from the element to the head of the square pin shown in FIG. 18B.

It is possible that a single linear or quadrature dual linear polarized radiation element may be useful in some cases. In these cases, the on-board microstrip quadrature-to-circular polarization circuit would not be required. The rear side cavity pins or edged pins, however, shown in FIGS. 17 and 18, can still be used for interconnection to a beam forming network module.

As to the square pin, it allows ease of wire or ribbon bonding to the module. The square pin also, if sized properly, when pressed into the dielectric, such as sold under the trade designation Teflon, will expand the dielectric enough to trap the pin and dielectric in the drill hole from the array face back to the module. In some instances with various types of pins, ball bonds are used forming a thermal compression weld joint that attaches the pin to the metal terminal pad on the microstrip quadrature-to-circular polarization circuit. The wedge bond, on the other hand, is a type of thermal compression weld joint that attaches the pin to a metal pad. A typical microelectronic connection is made with a 0.001 inch diameter gold wire where a thermal compression, TC, ball bond attachment is used at the semiconductor bonding pad. A wedge TC bond is made at the other end of the wire to connect it to a packaged metal land.

Figure 8:
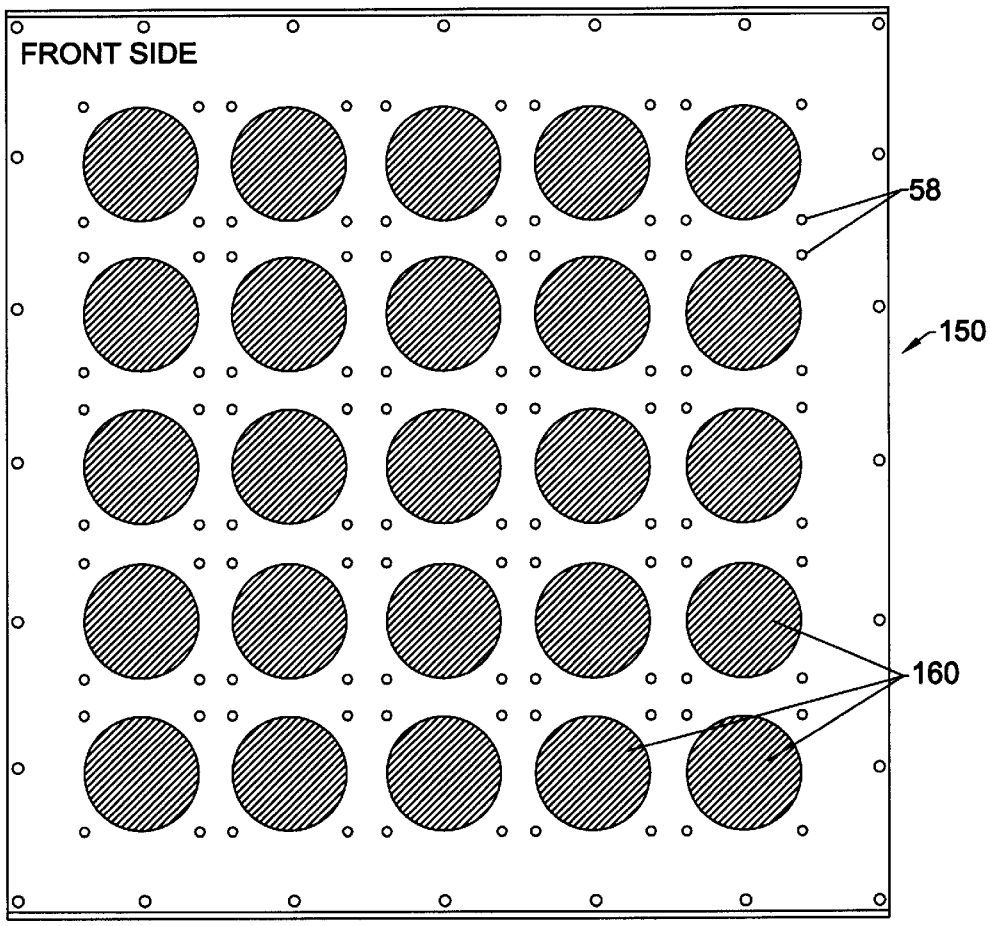
FIG. 8 is a front side view of a preformed phased array antenna wafer of antenna elements before cutting.
Figure 9:
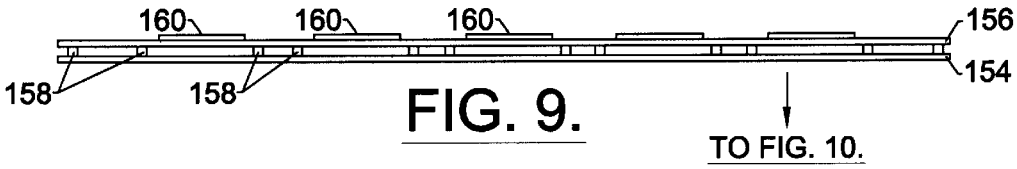
FIG. 9 is an elevation view of the preformed phased array antenna wafer of FIG. 8.
Figure 10:
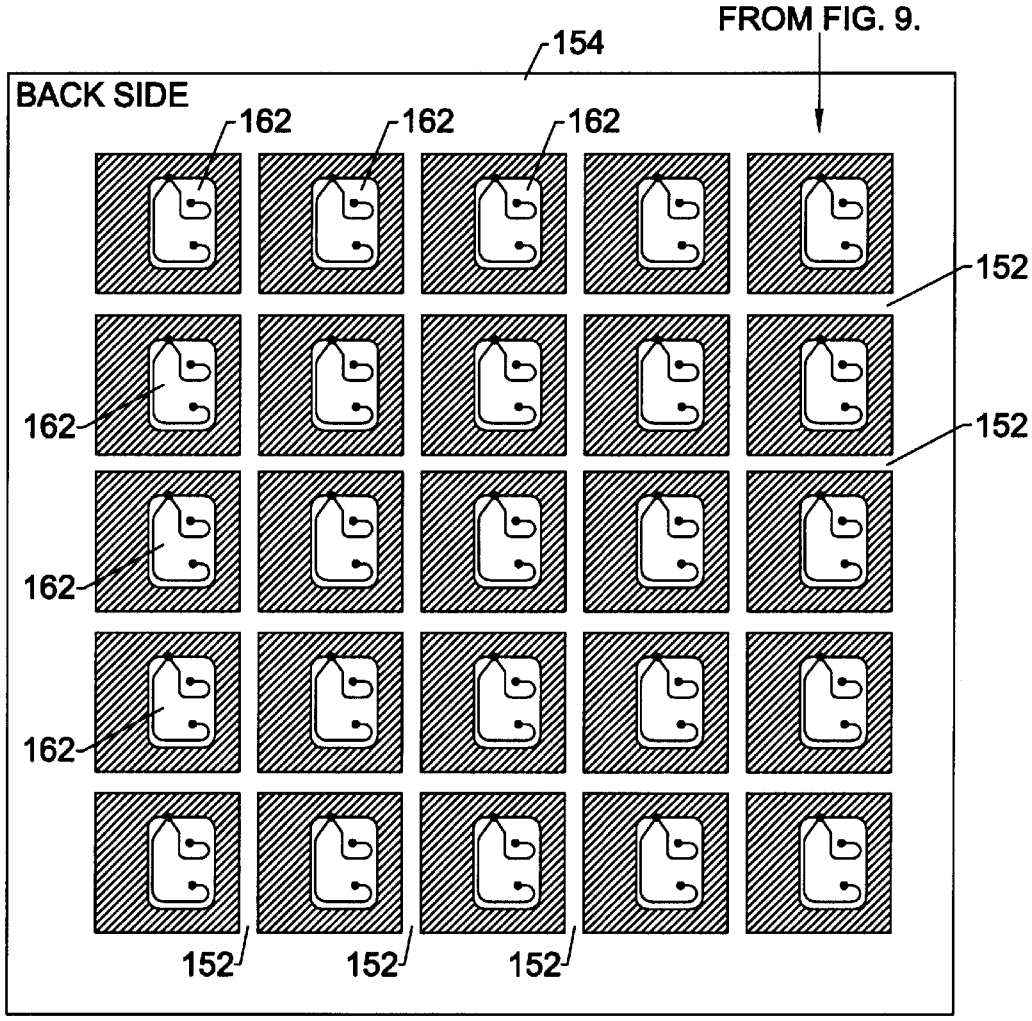
FIG. 10 is a back side view of the wafer of FIG. 8 and showing the microstrip quadrature-to-circular polarization elements.

FIGS. 8–10 show how the patch antenna elements can be formed as a wafer 150 of elements and then cut by a diamond saw along cut lines 152. A primary substrate 154 is illustrated as a large wafer, together with the secondary substrate 156, which is spaced by spherical balls 158 as described before. A parasitic patch antenna element 160 is formed on the secondary substrate. The primary substrate would include appropriate driven antenna elements and, if necessary, ground plane layers (not shown), as known to those skilled in the art. Microstrip quadrature-to-circular polarization circuits 162 are formed on the backside of the primary substrate 154. In one example, the elements are formed on a 1.00 inch square primary substrate. The wafer could be sawed apart to yield 25 elements on a 0.150 by 0.150 inch square. Standard thickness could be 1.0 mm and 0.5 mm+/−0.01 mm thickness, with standard semiconductor three inch, four inch, and six inch wafers.

In yet another aspect of the present invention, it is possible to have a phased array antenna that includes an antenna support interconnecting member 200 mounted on the antenna housing. Referring now to FIGS. 19–24, there is shown an antenna support interconnect member 200 that can be used in the present invention. This antenna support interconnect member allows planar elements to be electrically connected to circuitry positioned orthogonal to elements such as the module 39 and must meet microwave and millimeter wavelength frequency performance requirements to be consistent for interconnection. It allows a cable interconnection and interconnective circuitry to be contained on the orthogonal planes as described below, and eliminates one level of assembly interconnect. It also can use wire or ribbon bond interconnects with epoxy mounting and provides high density interconnects for dimensional accuracy with decreased system size required for Ka band systems and increased performance.

Figure 24:
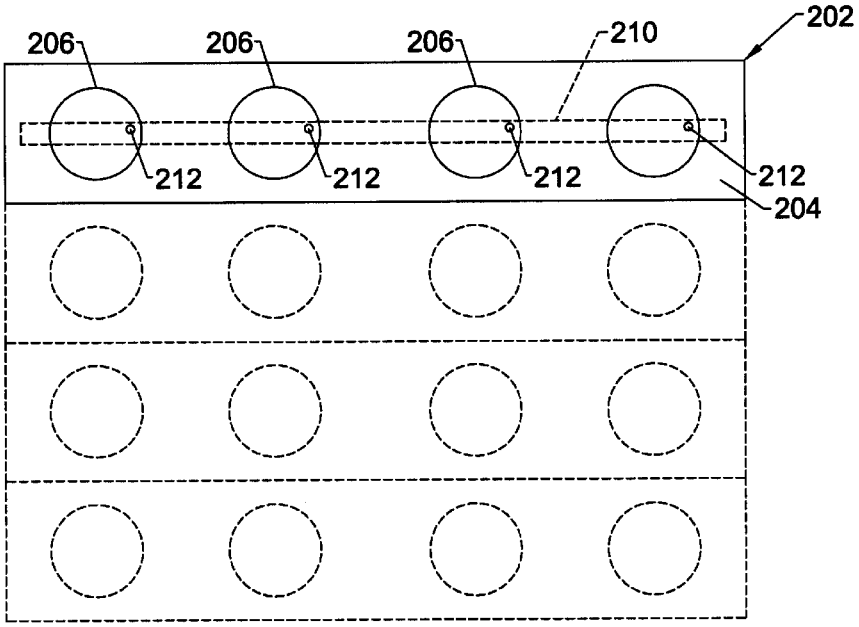
FIG. 24 is a fragmentary front elevation view of an array face showing one of the interconnect members fixed into the antenna housing.

FIG. 24 illustrates a carrier member 202 that has a front antenna mounting surface 204 substantially orthogonal to the modular support and supports four patch antenna elements 206, although the number of patch antenna elements can vary as known to those skilled in the art. The patch antenna elements can be similar in construction with primary and secondary substrates and other elements as described above. A rear surface 208 has a receiving slot 210 and is positioned to extend through the carrier member 202 to a circuit element supported on the mounting surface, which in this instance, is the antenna element. It is seen that a conductive via 212 (FIGS. 23 and 24) is associated with the receiving slot 210 and positioned to extend through the carrier member 202 to the antenna element.

Figure 19:
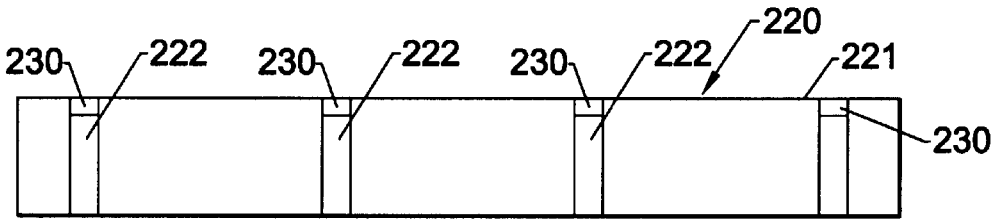
FIG. 19 is a plan view of a launcher member used in the interconnect member in one aspect of the present invention.
Figure 20:
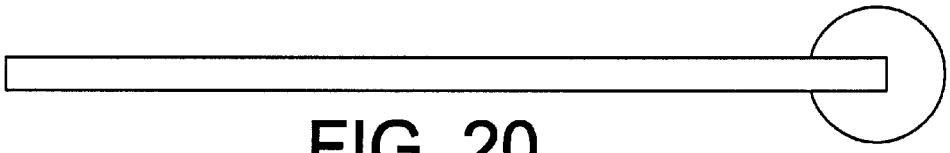
FIG. 20 is a side elevation view of the launcher member shown in FIG. 19.
Figure 21:
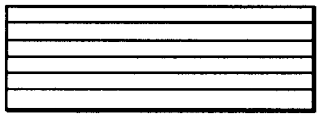
FIG. 21 is an enlarged view of the launcher member shown in FIG. 20.
Figure 22:
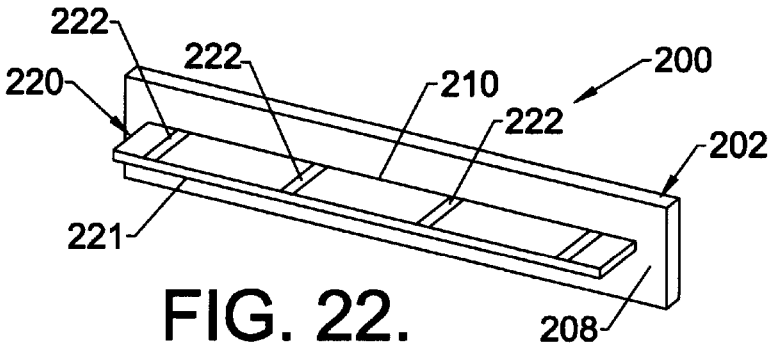
FIG. 22 is an isometric view of the launcher member and carrier member that have been fired together.
Figure 23:
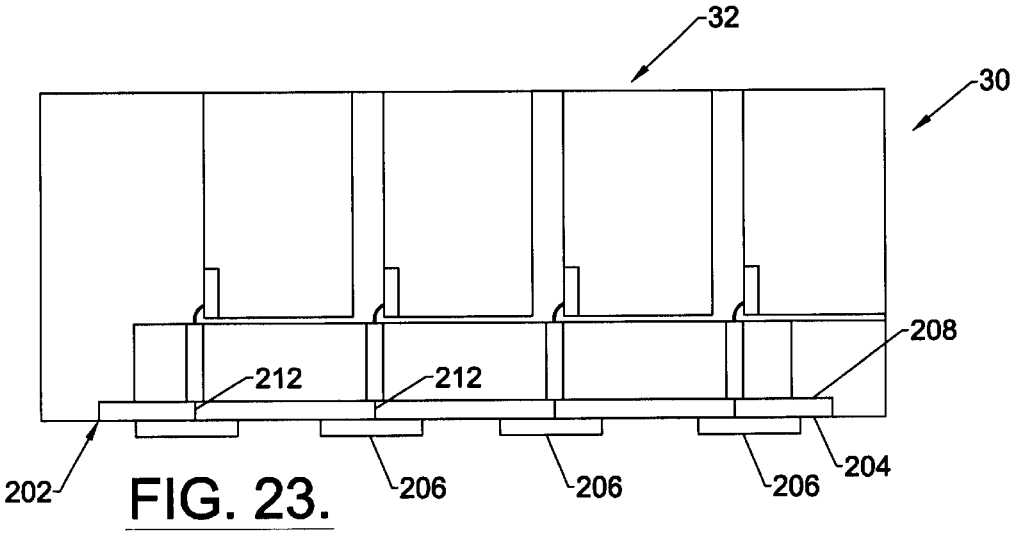
FIG. 23 is a fragmentary view of the carrier member and launcher member connected to the antenna housing.

A launcher member 220 is fitted into the receiving slot 210 and has a module connecting end 221 extending rearward to a beam forming network or other orthogonally positioned circuits within the antenna housing or other housing. The module connecting end could connect to a ceramic microstrip element as described before. The launcher member 220 includes conductive signal traces 222 that extend along the launcher member from the conductive via 212 to a module connecting end positioned adjacent the beam forming network module, for example, the launcher member is shown in greater detail in FIGS. 19–21, showing the conductive signal traces. The launcher member 220 and carrier member 202 are formed from a stacked layer of green tape ceramic sheets, which allow various circuits to be formed between layers. Thus, various interconnects and signal traces can be formed by printed technology for microwave circuits, as known to those skilled in the art. It is evident that because the members are formed from green tape ceramic in layers, the carrier member and launcher member can be fitted together and then shrink bonded together during firing to create an integral circuit connection. The firing of the green tape allows the signal traces, vias and conductive signal traces to connect together and remain bonded. A bond pad 230 can also be formed on the module connecting end. This bond pad can support a ribbon bond or other bond that connects to a beam forming network module or other orthogonally positioned circuit or module. It is seen that the launcher member is positioned substantially 90° to the carrier member in one aspect of the present invention, but could be positioned at any angle. Both the carrier member and launcher member are substantially rectangular configured and the antenna support and interconnect member and antenna housing can be configured to fit together in a locking relationship.

This application is related to copending patent applications entitled, "PHASED ARRAY ANTENNA HAVING PATCH ANTENNA ELEMENTS WITH ENHANCED PARASITIC ANTENNA ELEMENT PERFORMANCE AT MILLIMETER WAVELENGTH RADIO FREQUENCY SIGNALS," and "PHASED ARRAY ANTENNA WITH INTERCONNECT MEMBER FOR ELECTRICALLY CONNECTING ORTHOGONALLY POSITIONED ELEMENTS USED AT MILLIMETER WAVELENGTH FREQUENCIES," which are filed on the same date and by the same assignee, the disclosures which are hereby incorporated by reference.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. A phased array antenna comprising:

an antenna housing having a subarray assembly and a plurality of beam forming network module and an array face defining a ground plane substantially orthogonal to the subarray assembly and beam forming network modules;

a plurality of millimeter wavelength patch antenna elements positioned on said array face and each positioned adjacent a respective beam forming network module, said millimeter wavelength patch antenna elements each comprising:

a driven antenna element having a front and rear side;

a parasitic antenna element positioned forward of the front side of the driven antenna element; and a microstrip quadrature-to-circular polarization circuit positioned rearward of the rear side of the driven antenna element and operatively connected to said driven antenna element; and a single millimeter wavelength feed operatively connecting said microstrip quadrature-to-circular polarization circuit with a respective adjacent beam forming network module supported on said orthogonal positioned subarray assembly.

2. A phased array antenna according to claim 1, and further comprising an electrically conductive ground plane layer and a dielectric layer positioned between the parasitic antenna element and the microstrip quadrature-to-circular polarization circuit.

3. A phased array antenna according to claim 1, wherein said single millimeter wavelength feed further comprises a conductive pin having a ball bond that interconnects said microstrip quadrature-to-circular polarization circuit.

4. A phased array antenna according to claim 3, and further comprising a wedge bond and ceramic microstrip substrate that interconnects said conductive pin to said beam forming network module.

5. A phased array antenna according to claim 4, wherein said single millimeter wavelength feed comprises a wire bond that interconnects said ceramic microstrip substrate to said beam forming network module.

6. A phased array antenna according to claim 5, and further comprising a ribbon bond that interconnects said single millimeter wavelength feed.

7. A phased array antenna according to claim 1, wherein said plurality of millimeter wavelength patch antenna elements are conductively bonded to said array face of said antenna housing.

8. A phased array antenna according to claim 1, wherein said beam forming network module further comprises an amplifier.

9. A phased array antenna according to claim 8, wherein said beam forming network module further comprises a monolithic microwave integrated circuit (MMIC).

10. A phase array antenna according to claim 1, wherein said antenna housing further comprises a housing core defining said subarray assembly, a cover and waveguide mode filter posts extending from the cover to the housing core.

11. A phased array antenna comprising:

an antenna housing having a subarray assembly and a plurality of beam forming network modules and an array face substantially orthogonal to the subarray assembly and beam forming network modules, said array face including a plurality of waveguide below cut-off cavities formed within the array face and each positioned adjacent a respective beam forming network module; and a millimeter wavelength patch antenna element positioned over each conducting waveguide cavity, and comprising:

a driven antenna element having a front and rear side;

a parasitic antenna element positioned forward of the front side of the driven antenna element; and a microstrip quadrature-to-circular polarization circuit positioned rearward of the rear side of the driven antenna element, at least partially received within said waveguide below cut-off cavity and operatively connected to said driven antenna element; and a single millimeter wavelength feed connecting said microstrip quadrature-to-circular polarization circuit and a respective adjacent beam forming network module supported on said orthogonal positioned subarray assembly.

12. A phased array antenna according to claim 11, and further comprising a ground plane layer and a dielectric layer positioned between the parasitic antenna element and the microstrip quadrature-to-circular polarization circuit.

13. A phased array antenna according to claim 11, wherein said single millimeter wavelength feed further comprises a conductive pin having a ball bond that interconnects said microstrip quadrature-to-circular polarization circuit.

14. A phased array antenna according to claim 13, and further comprising a wedge bond that interconnects said conductive pin to said beam forming network module.

15. A phased array antenna according to claim 11, wherein said single millimeter wavelength feed comprises a wire bond that interconnects said microstrip quadrature-to-circular polarization circuit.

16. A phased array antenna according to claim 15, and further comprising a ribbon bond that interconnects said single millimeter wavelength feed to said beam forming network module.

17. A phased array antenna according to claim 11, wherein said plurality of millimeter wavelength patch antenna elements are conductively bonded to said array face of said antenna tray housing.

18. A phased array antenna according to claim 11, wherein said beam forming network module further comprises an amplifier.

19. A phased array antenna according to claim 18, wherein said beam forming network module further comprises a monolithic microwave integrated circuit (MMIC).

20. A phase array antenna according to claim 11, wherein said antenna housing further comprises a housing core defining a module support, a cover and waveguide mode filter posts extending from the cover to the housing core.

21. A phased array antenna comprising:

an antenna housing having a subarray assembly and a plurality of beam forming network modules and an array face substantially orthogonal to the subarray assembly and beam forming network modules, said array face including a plurality of waveguide below cut-off cavities formed within the array face and each positioned adjacent a respective beam forming network module; and a millimeter wavelength patch antenna element positioned over each conducting waveguide cavity, and comprising:

a primary substrate having front and rear sides;

a driven antenna element positioned on the front side of said primary substrate;

a secondary substrate spaced forward from said driven antenna element and having a parasitic antenna element positioned thereon;

a ground plane layer positioned on said rear side of said primary substrate;

a dielectric layer positioned on said ground plane layer;

a quadrature microstrip circular polarized circuit positioned on said dielectric layer and at least partially received within said conducting waveguide cavity;

conductive signal vias extending from said microstrip quadrature-to-circular polarization circuit to said ground plane layer and said driven antenna element;

a single millimeter wavelength feed connecting said microstrip quadrature-to-circular polarization circuit with a respective adjacent positioned beam forming network module supported on said orthogonal positioned subarray assembly.

22. A phased array antenna according to claim 21, wherein said primary substrate is formed from a dielectric material.

23. A phased array material according to claim 22, wherein said primary substrate is formed from the group consisting of glass, including fused quarts, a semiconductor substrate, including GaAs, and ceramics, including alumina and beryllia.

24. A phased array antenna according to claim 21, wherein said secondary substrate is formed from a dielectric material.

25. A phased array antenna according to claim 21, wherein said single millimeter wavelength feed further comprises a conductive pin having a ball bond that interconnects said microstrip quadrature-to-circular polarization circuit.

26. A phased array antenna according to claim 21, and further comprising a wedge bond that interconnects said conductive pin to said beam forming network module.

27. A phased array antenna according to claim 21, wherein said single millimeter wavelength feed comprises a wire bond that interconnects said microstrip quadrature-to-circular polarization circuit.

28. A phased array antenna according to claim 27, and further comprising a ribbon bond that interconnects said single millimeter wavelength feed to said beam forming network module.

29. A phased array antenna according to claim 21, wherein said plurality of millimeter wavelength patch antenna elements are conductively bonded to said array face of said antenna tray housing.

30. A phased array antenna according to claim 21, wherein said beam forming network module further comprises an amplifier.

31. A phased array antenna according to claim 30, wherein said beam forming network module further comprises a monolithic microwave integrated circuit (MMIC).

32. A phase array antenna according to claim 21, wherein said antenna housing further comprises a housing core defining said subarray assembly, a cover and waveguide mode filter posts extending from the cover to the housing core.

* * * * *